US009246237B2

(12) United States Patent
Jagielski et al.

(10) Patent No.: US 9,246,237 B2
(45) Date of Patent: Jan. 26, 2016

(54) DUAL ANTENNA, SINGLE FEED SYSTEM

(75) Inventors: Ole Jagielski, Frederickshavn (DK); Simon Svendsen, Aalborg (DK)

(73) Assignee: Molex, LLC, Lisle, IL (US)

( * ) Notice: Subject to any disclaimer, the term of this patent is extended or adjusted under 35 U.S.C. 154(b) by 76 days.

(21) Appl. No.: 13/878,647

(22) PCT Filed: Oct. 12, 2011

(86) PCT No.: PCT/US2011/055979
§ 371 (c)(1),
(2), (4) Date: Apr. 10, 2013

(87) PCT Pub. No.: WO2012/051311
PCT Pub. Date: Apr. 19, 2012

(65) Prior Publication Data
US 2013/0187817 A1 Jul. 25, 2013

Related U.S. Application Data

(60) Provisional application No. 61/392,181, filed on Oct. 12, 2010.

(51) Int. Cl.

| | |
|---|---|
| ***H01Q 9/00*** | (2006.01) |
| ***H01Q 21/30*** | (2006.01) |
| ***H01Q 1/24*** | (2006.01) |
| ***H01Q 9/04*** | (2006.01) |
| ***H01Q 5/371*** | (2015.01) |
| ***H01Q 5/40*** | (2015.01) |

(52) U.S. Cl.
CPC ..... *H01Q 21/30* (2013.01); *H01Q 1/243* (2013.01); *H01Q 5/371* (2015.01); *H01Q 5/40* (2015.01); *H01Q 9/0421* (2013.01); *H01Q 9/0457* (2013.01)

(58) Field of Classification Search
CPC ..... H01Q 9/00
USPC ..... 343/751, 770, 848
See application file for complete search history.

(56) References Cited

U.S. PATENT DOCUMENTS

| | | | |
|---|---|---|---|
| 5,903,240 | A | 5/1999 | Kawahata et al. |
| 6,462,714 | B1 | 10/2002 | Okabe et al. |

(Continued)

FOREIGN PATENT DOCUMENTS

| | | | |
|---|---|---|---|
| CN | 1635663 | A | 7/2005 |
| CN | 1930731 | A | 3/2007 |
| CN | 101740852 | A | 6/2010 |
| EP | 1 471 601 | A1 | 10/2004 |
| GB | 2 359 929 | A | 9/2001 |
| WO | WO 2011/031668 | A1 | 3/2011 |

OTHER PUBLICATIONS

International Search Report for PCT/US2011/055979.

*Primary Examiner* — Huedung Mancuso
(74) *Attorney, Agent, or Firm* — Stephen L. Sheldon

(57) ABSTRACT

An antenna system includes a low-band antenna configured for low-band frequencies and a high-band antenna configured for high-band frequencies. The low-band antenna is configured so that high-band frequencies have a high impedance while the high-band antenna is configured so that low-band frequencies have a high impedance. A transmission line can be used to couple both antennas together and the transmission line can be used to add phase delay to the impedance of the low-band and high-band antennas so that the corresponding frequencies that the antennas are not configured for are shifted toward an infinite impedance point on a Smith chart.

4 Claims, 8 Drawing Sheets

(56) References Cited

U.S. PATENT DOCUMENTS

| | | | |
|---|---|---|---|
| 6,958,730 | B2 | 10/2005 | Nagumo et al. |
| 7,148,849 | B2 | 12/2006 | Lin |
| 7,403,160 | B2 | 7/2008 | Chiang et al. |
| 8,120,542 | B2 | 2/2012 | Shoji |
| 2005/0200545 | A1 | 9/2005 | Bancroft |
| 2007/0115183 | A1 | 5/2007 | Kim et al. |
| 2009/0174604 | A1 | 7/2009 | Keskitalo et al. |
| 2011/0133994 | A1 | 6/2011 | Korva |

DUAL ANTENNA, SINGLE FEED SYSTEM

RELATED APPLICATIONS

This application is a national phase of PCT Application No. PCT/US2011/055979, filed Oct. 12, 2011, which in turn claims priority to U.S. Provisional Application No. 61/392,181, filed Oct. 12, 2010, which is incorporated herein by reference in its entirety.

FIELD OF THE INVENTION

The present invention relates to the field of antennas, more specifically to the field of antennas suitable for use in portable devices.

BACKGROUND

The use of an indirect-fed antenna has a number of benefits and the discussion of this technology is provided in PCT Application No. PCT/US 10/4797, filed Sep. 7, 2010, which is incorporated herein by reference in its entirety. FIG. 1 illustrates an exemplary design that can be used to provide such a system. A low band antenna 30 includes a feed 31 that is coupled to a coupler 32. The coupler 32 couples with a high-band element 35 that has a short 37 that couples to the high-band element 35 to ground. A high-band antenna 40 includes feed that is coupled to slot 42, which has a short 47 to ground. A high-band element 45 capacitively couples to the slot 42 and has a short 48 to ground. Both the low-band and high-band antennas can be configured with the appropriate components so as to ensure the frequency response is appropriate. For example, an inductor or capacitor can be place in series with the coupler to adjust the impedance of the low band antenna. In addition, an inductor can be place in series between the high-band element and the ground to adjust the impedance of the high band antenna.

An impedance plot of the Low Band HISF antenna is shown in FIG. 2A for the raw antenna and in FIG. 2B when matched to 50Ω. As can be appreciated from FIGS. 2A and 2B, a low-band frequency range 51, which can extend from a starting value 51*a* (which can be a lower end of GSM 850) to an ending value 51*b* (which can be an upper end of GSM 900) is shifted into a desired position on the Smith chart with the use of the appropriate components (e.g., the addition of an inductor or capacitor between the feed and coupler) so that the response over the low-band frequency 51 is within a standing wave ratio (SWR) circle 55, which can have a value of 3.

An impedance plot of the High Band LISF antenna is shown in FIG. 3A for the raw antenna and in FIG. 3B for an antenna matched to 50Ω. As can be appreciated from FIGS. 3A and 3B, a high-band frequency range 52, which can extend from a starting value 52*a* (which can be a lower end of GSM 1800) to an ending value 52*b* (which can be an upper end of UMTS 1 (Rx) is shifted into a desired position on the Smith chart so that the response over the high-band frequency 52 is within the SWR circle 55.

While the depicted system is relatively compact, pressure to make mobile devices smaller and more energy efficient while at the same time increase performance has created increased pressure on the communication system. Chip designers are integrating multiple communication chipsets into CPU designs in an attempt to maximize efficiency and performance. Developing an antenna system that could somehow enhance the communication system performance would therefore be appreciated by certain individuals.

BRIEF SUMMARY

An antenna system includes a low-band antenna configured for low-band frequencies and a high-band antenna configured for high-band frequencies. The low-band and high-band antenna can be fed by a single transceiver and are coupled together by a transmission line that can be a desired length. The low-band antenna is configured so that high-band frequencies have a high impedance while the high-band antenna is configured so that low-band frequencies have a high impedance. The transmission line can be used to add phase delay to the impedance of the low-band and high-band antennas so that the corresponding frequencies that the antennas are not configured for are shifted toward an infinite impedance point on a Smith chart.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 2A:
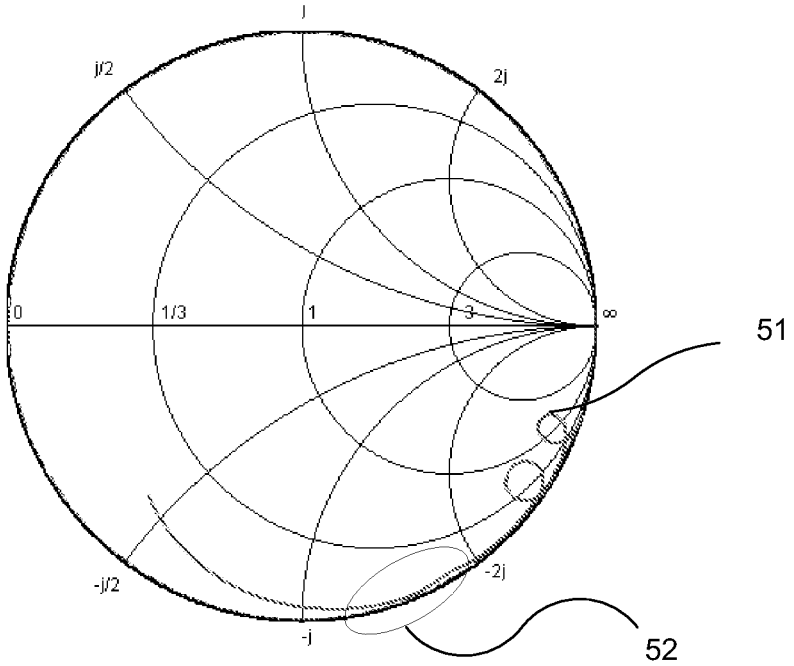
FIG. 2A illustrates an impedance plot of a low-band antenna on a smith chart prior to tuning.
Figure 2B:
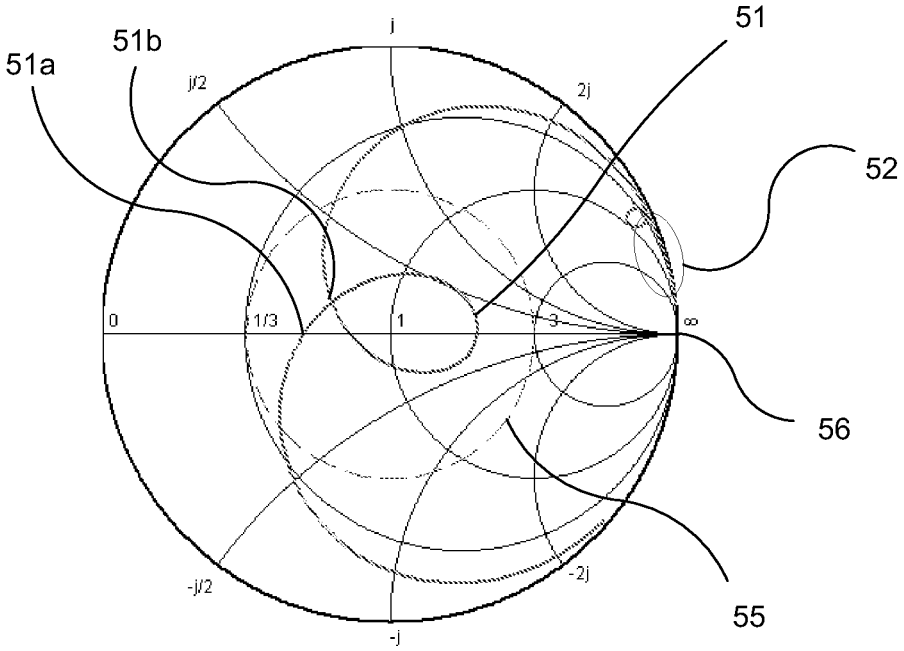
FIG. 2B illustrates an impedance plot of a low-band antenna on a smith chart after tuning.

As can be appreciated from FIG. 2B, when low band antenna is configured so that the low-band frequency range 51 is positioned within the SWR circle 55, the high-band frequency range 52 is positioned close to the infinite impedance position on the Smith chart. Similarly, as can be appreciated from FIG. 3B, when the high band high-band frequency range 52 is positioned within the SWR circle 55, the high-band frequency range 52 is positioned near the infinite impedance position on the Smith chart. It has been determined that it would be beneficial to adjust both antennas so that the corresponding high or low band frequencies could be shifted closer to the infinite impendence point on the Smith chart. Or to put it another way, in an embodiment one can have the frequencies of the non-resonance bands at a high impedance point in the smith chart (center right side), whereby the two antennas can be combined to a single fed antenna by simply adding the two 50Ω feeding points together.

Figure 3A:
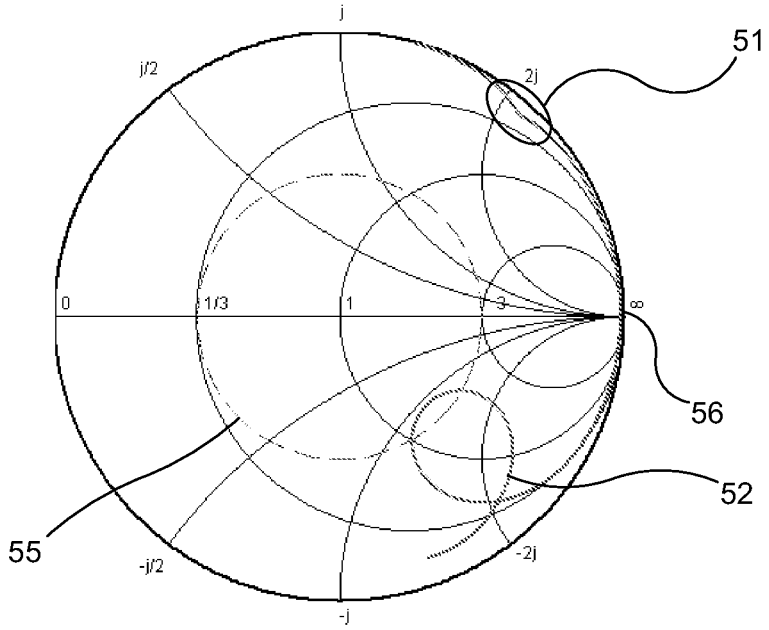
FIG. 3A illustrates an impedance plot of a high-band antenna on a smith chart prior to tuning.
Figure 3B:
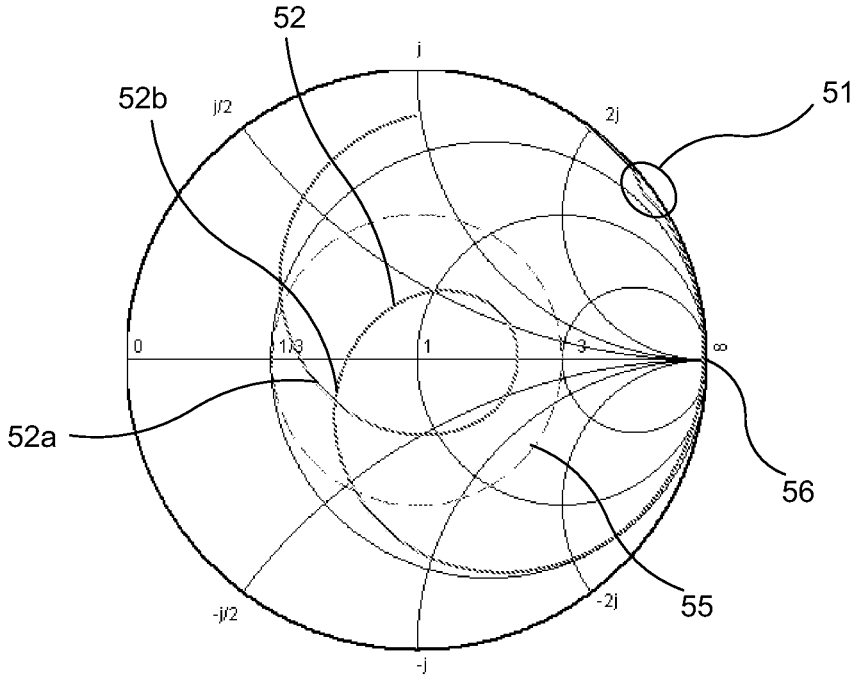
FIG. 3B illustrates an impedance plot of a high-band antenna on a smith chart after tuning.
Figure 4A:
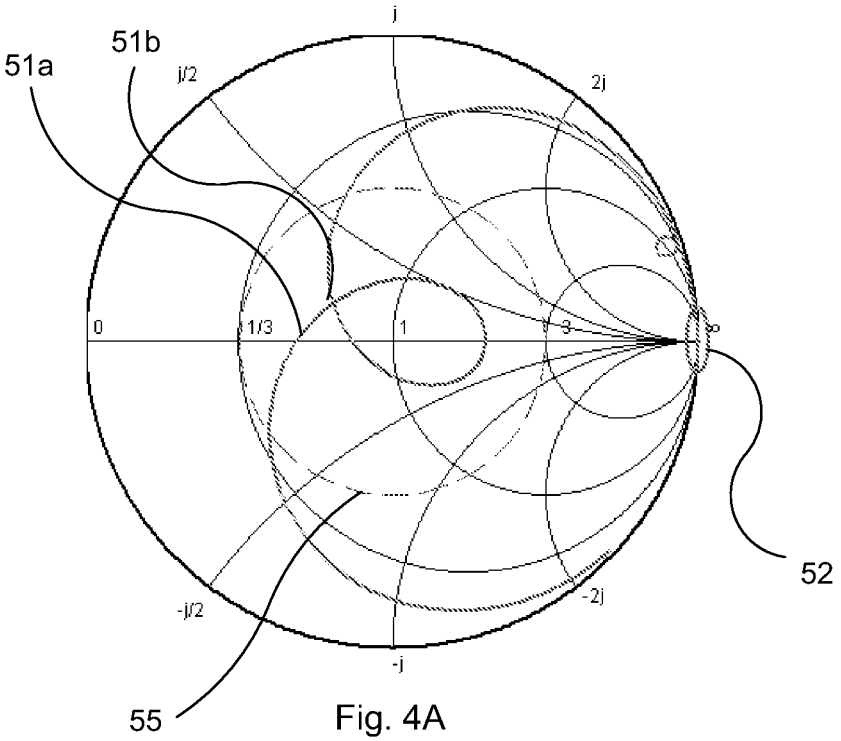
FIG. 4A illustrates an impedance plot of a low-band antenna on a smith chart after phase delay is added.
Figure 4B:
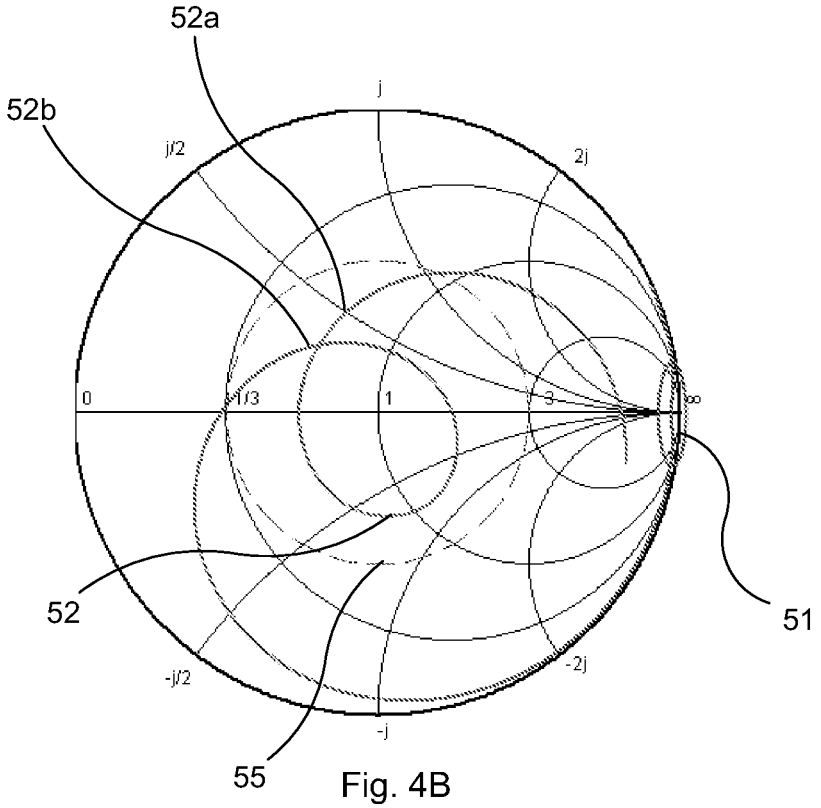
FIG. 4B illustrates an impedance plot of a high-band antenna on a smith chart after phase delay is added.

The choice of feeding technique, LISF vs. HISF and the position of the resonance bands in the smith chart, before the match into 50Ω, have been optimized to have the non-resonance bands as close to the high impedance point in the smith chart as possible (See FIGS. 2B and 3B). The non-resonance bands can then be rotated into the high impedance region in the smith chart, after the resonance bands have been matched to 50Ω, as shown in FIGS. 4A and 4B (with low-band range 51 and high-band range 52 being marked with ovals). It has been determined that a useful method for rotation is to add phase delay to each antenna system.

Figure 5:
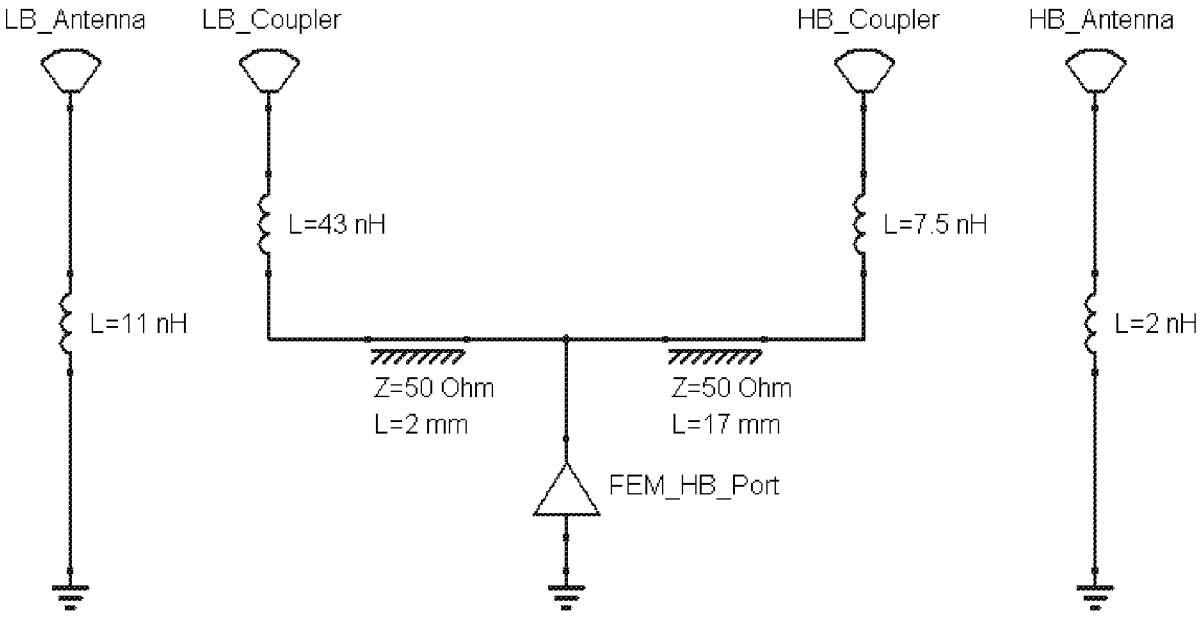
FIG. 5 illustrates a schematic of an embodiment of an antenna system with a transmission line coupling a low-band antenna and a high-band antenna.
Figure 6:
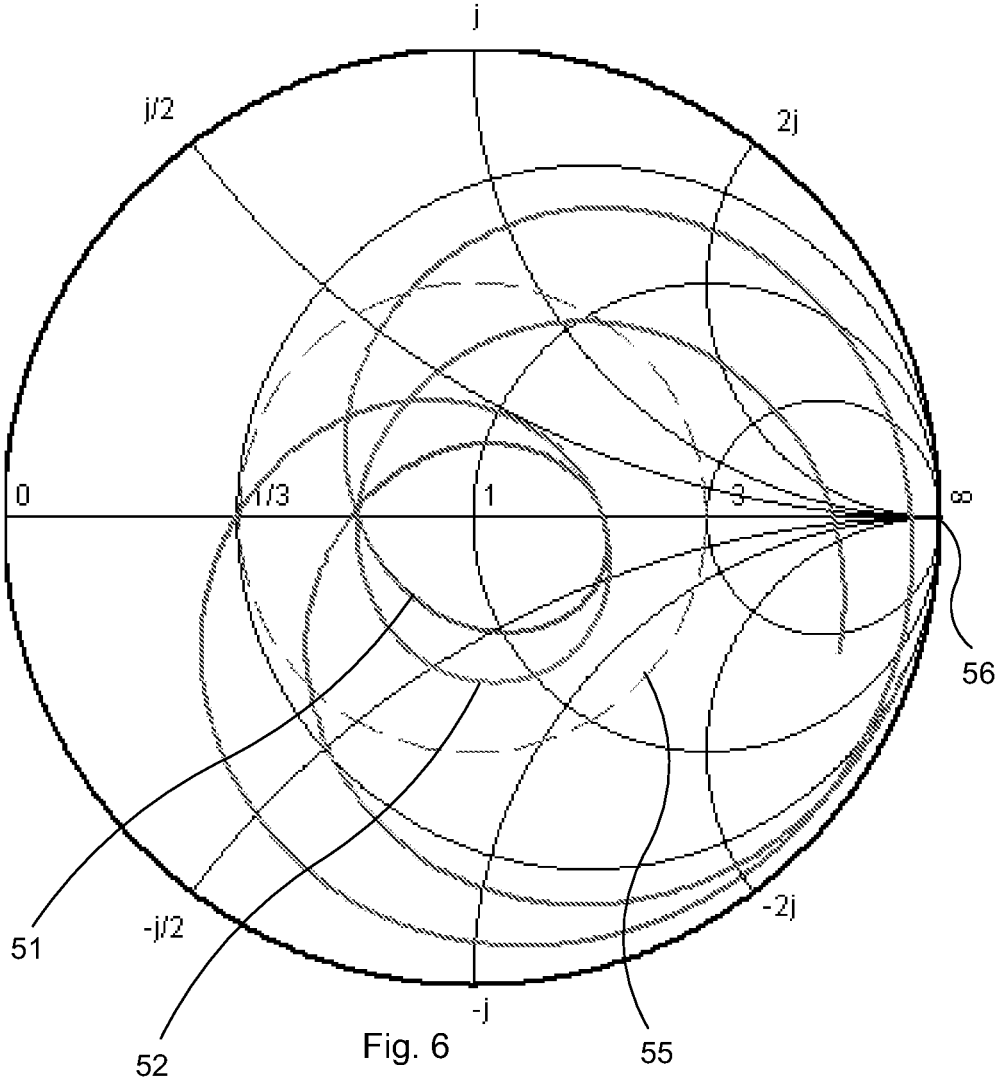
FIG. 6 illustrates a plot of the complex impedance of the antenna system depicted in FIG. 5.
Figure 7:
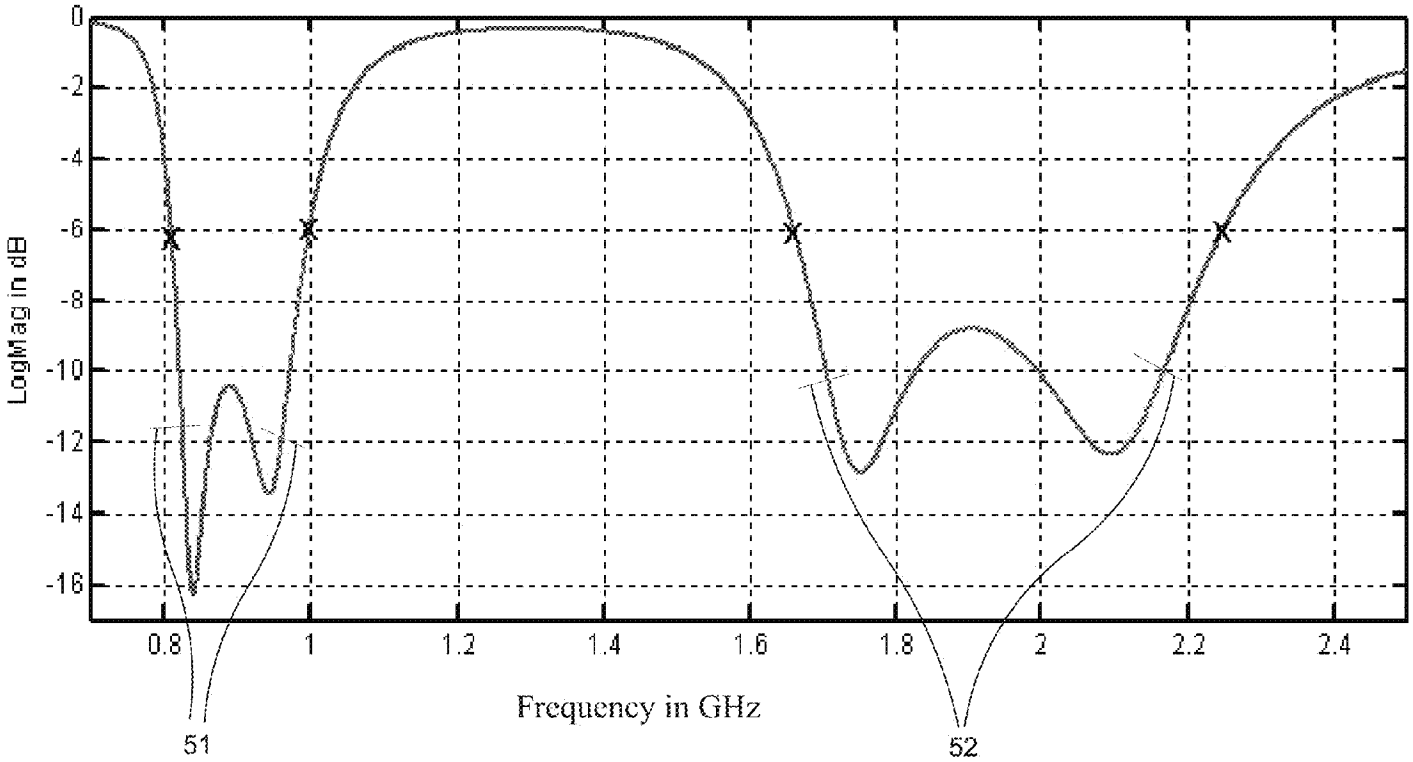
FIG. 7 illustrates a plot of log magnitude impedance of the antenna system depicted in FIG. 5.

The phase delay for low band is achieved with a 2 mm long 50Ω transmission line, while the high band phase delay is achieved with a 17 mm transmission line. It is now possible to simply combine to the feed signals to achieve a single feed antenna, as is shown schematically in FIG. 5. The complex impedance of the combined antenna is shown in FIG. 6, while the log magnitude impedance is shown in FIG. 7.

The total length of the transmission lines used to combine the 2 signals path is simulated to 19 mm. However, the 19 mm is for a transmission lines in air (electrical length), which is very unlikely in mobile device designs because transmission lines often are designed into a circuit board. In that regard, FR4 is a most common substrate used for circuit boards and has a dielectric constant of around 4.5. An electrical length of 19 mm in air equates to about a physical length of around 9 mm in a typical FR4 substrate.

Figure 1:
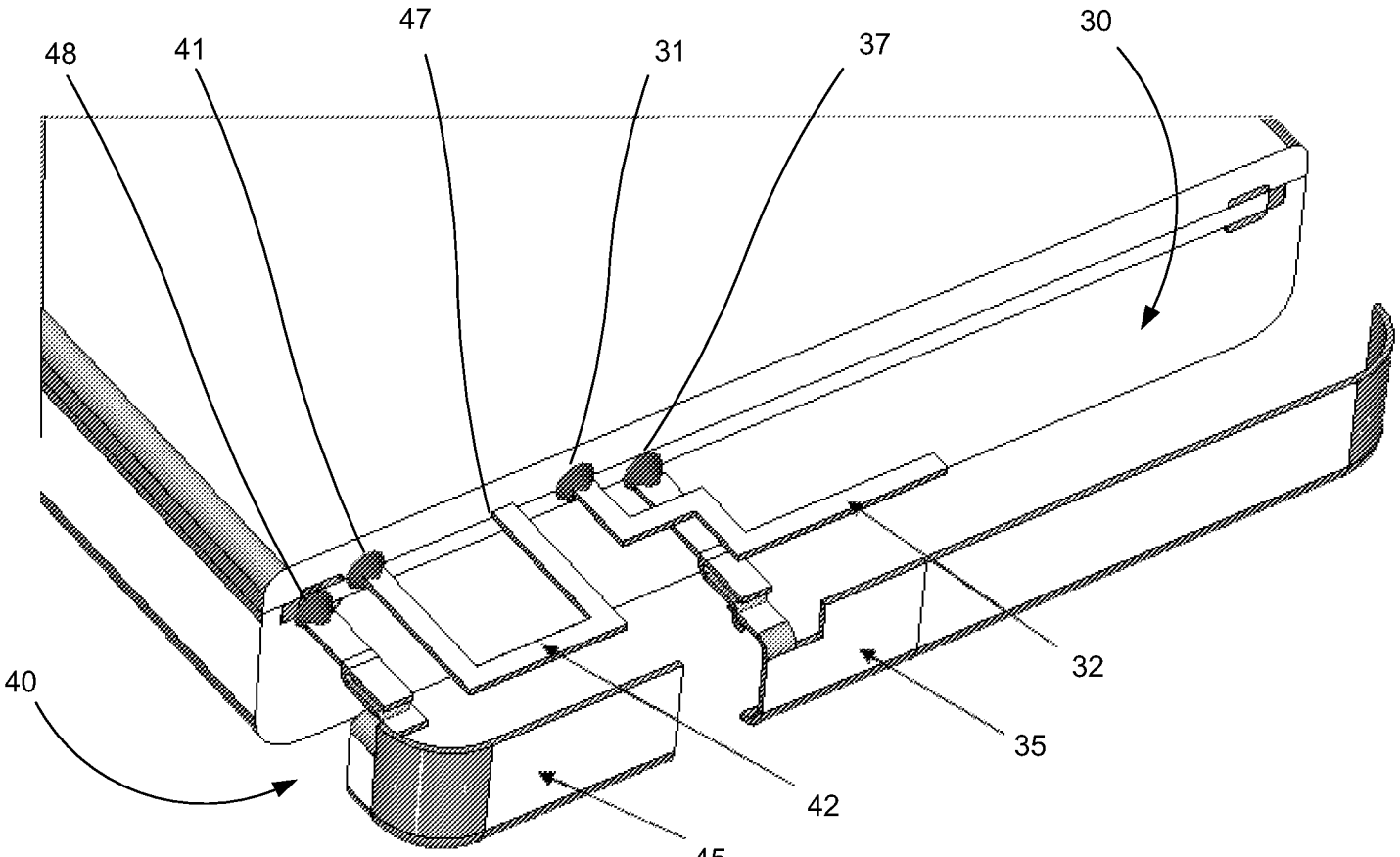
FIG. 1 illustrates a perspective view of an embodiment of an antenna system.

The reference antenna concept shown in FIG. 1 has a physical distance of 10 mm between the feed of the LISF and the feed of the HISF. This length is a bit longer than the expected length of 9 mm in FR4. However, it has been determined that acceptable performance can be accomplished even if a length of the transmission line is not optimal. Notably, as the non-resonance bands are naturally in the high impedance region of the Smith chart and have a low phase velocity, it is expected that minimal use of a transmission line (or extra long transmission lines) will still work in many situations where the antenna system has high bandwidth.

It should be noted, however, that for systems that have higher Q antenna elements it is expected that a more accurate transmission line will be beneficial. This because such antennas tend to have reduced impedance bandwidth and faster phase velocity at the non resonance bands.

While the above system of transmission lines could be used with standard direct feed antennas, the reduced bandwidth and increased phase velocity tends to require a much longer transmission line (about 4 times as long). Such a long transmission line become impractical in portable systems and therefore is unlikely to be useful in any system that would benefit from a compact system. Compared to using slot fed antennas, standard direct fed antennas also require a more accurate/precise design and tend to suffer from increased bandwidth loss due to the lower impedance bandwidth and faster phase velocity of the non resonance bands. As can be appreciated, therefore, a number of undesirable changes are needed to use standard direct fed antennas. These are all factors that make it more difficult to combine such two standard direct fed antennas.

In addition to allowing for a single transceiver, another advantage of this concept is that the distance between the 2 feeds can be optimized to a specific distance, without affecting the Q of the antenna elements. This is possible due to the fact that the indirect feeds can be moved closer to each other while maintaining the Q of the elements because the elements themselves are not moved.

Figure 8:
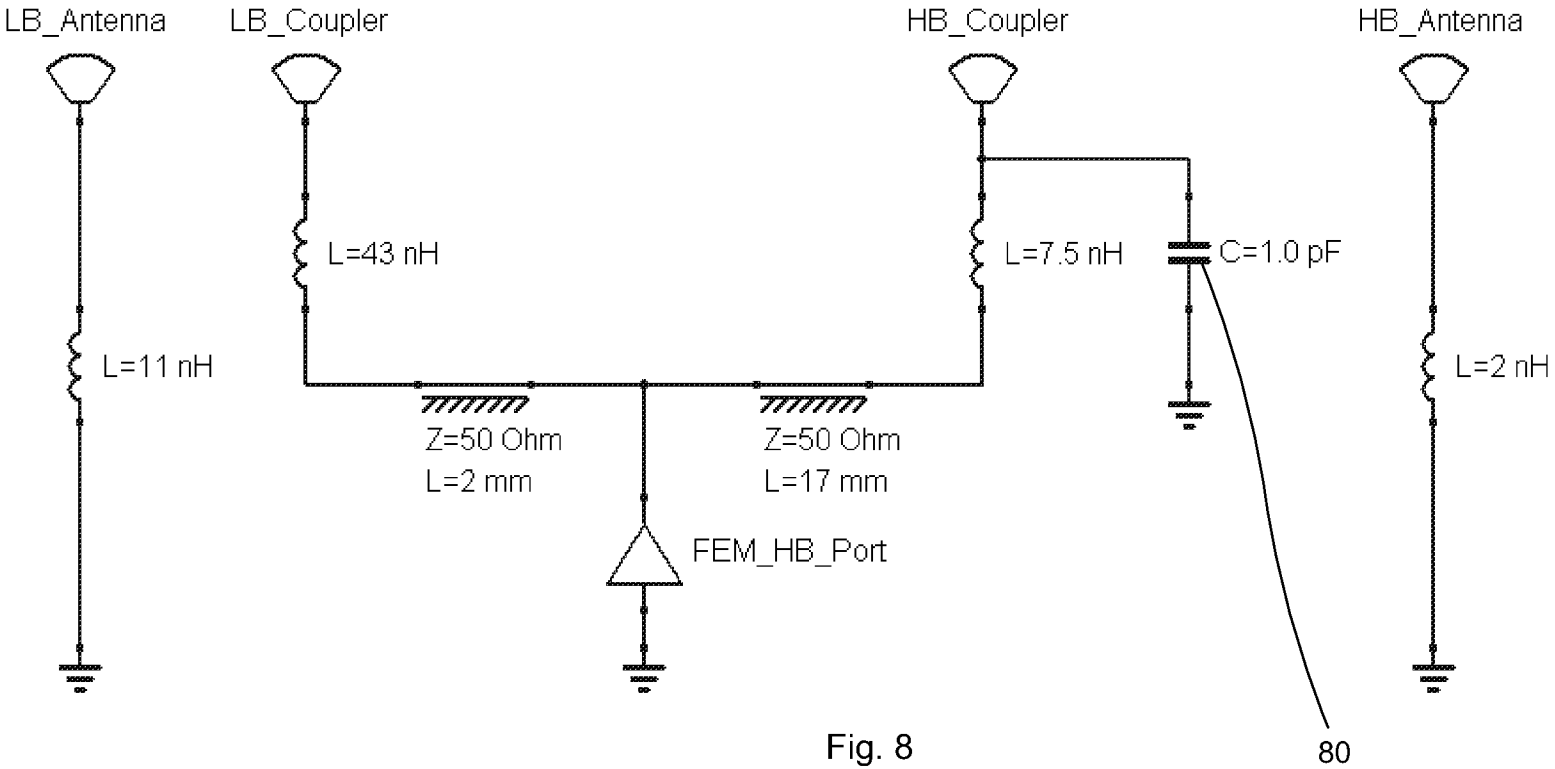
FIG. 8 illustrates a schematic of another embodiment of an antenna system with a transmission line coupling a low-band antenna and a high-band antenna.

Moving the slot feed will affect the phase shift of the antenna and it might not be possible and or feasible to obtain the required phase shift in the slot alone. However, an additional phase shift can be added by a discrete parallel capacitor in the circuit. For example, if the phase shift of the high band slot is too small for the high band frequencies to be matched to 50Ω with a series inductor, the phase shift can be increased by adding a capacitor 80, as shown in FIG. 8.

It is expected that the discrete tuning of the phase shift will most beneficial for the high band feed; however, discrete tuning of the phase shift can also be used on the low band feed. As can be appreciated, the example depicted in FIG. 8 discloses an embodiment that uses a discrete capacitor to tune a slot that has an electrical length that is too short. By replacing the capacitor with an inductor it is possible to tune a slot that has an electrical length that is too long.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An antenna system, comprising:

a first antenna configured to resonate in a low frequency band, the first antenna being indirectly fed; and a second antenna configured to resonate in a high frequency band, the second antenna being indirectly fed, wherein are both the first and second antenna are fed by a transmission line extending therebetween, the first antenna configured to provide a high impedance to high-band frequency input and the second antenna configured to provide a high impedance to a low-band frequency input, wherein the second antenna includes a slot with an electrical length and a capacitor configured to increase the electrical length of the slot.

2. The antenna system of claim 1, wherein the transmission line is coupled to a transceiver and a first distance along the transmission line between the transceiver and the first antenna is different than a second distance along the transmission line between the transceiver and the second antenna.

3. An antenna system, comprising:

a first antenna configured to resonate in a low frequency band, the first antenna being indirectly fed; and a second antenna configured to resonate in a high frequency band, the second antenna being indirectly fed, wherein are both the first and second antenna are fed by a transmission line extending therebetween, the first antenna configured to provide a high impedance to high-band frequency input and the second antenna configured to provide a high impedance to a low-band frequency input, wherein the second antenna includes a slot with an electrical length and an inductor configured to decrease the electrical length of the slot.

4. The antenna system of claim 3, wherein the transmission line is coupled to a transceiver and a first distance along the transmission line between the transceiver and the first antenna is different than a second distance along the transmission line between the transceiver and the second antenna.

* * * * *